United States Patent [19]

Birke et al.

[11] 3,961,885

[45] June 8, 1976

[54] PROCESS FOR THE DYEING OF SYNTHETIC FIBROUS MATERIALS FROM ORGANIC SOLVENTS USING AZO DYES

[75] Inventors: Walter Birke; Franz Schön, both of Frankfurt am Main; Willi Steckelberg, Hofheim, Taunus, all of Germany

[73] Assignee: Hoechst Aktiengesellschaft, Frankfurt am Main, Germany

[22] Filed: Nov. 1, 1973

[21] Appl. No.: 412,017

[30] Foreign Application Priority Data

Nov. 2, 1972 Germany ..... 2253582

[52] U.S. Cl. ..... 8/41 A; 8/41 B; 8/41 C; 8/41 D; 8/50; 8/173; 8/174; 8/175; 260/193

[51] Int. Cl.[2] ..... C09B 27/00

[58] Field of Search ..... 8/41 A, 41 B, 41 C, 8/41 D, 41 R, 71, 94; 260/193

[56] References Cited

UNITED STATES PATENTS 3,792,972 2/1974 Brenneisen ..... 8/41 A

*Primary Examiner*—Benjamin R. Padgett
*Assistant Examiner*—David Leland
*Attorney, Agent, or Firm*—Curtis, Morris & Safford

[57] ABSTRACT

A process for the continuous dyeing of textile materials consisting of or containing synthetic fibrous materials of the group consisting of high molecular polyamides, polyolefines, polyacrylonitriles, polyurethanes, polyvinylchlorides, polyvinylacetates, cellulose-2 ½-acetate, cellulose-triacetate and high molecular polyesters from organic solvents, which comprises impregnating the said fibrous materials with organic dyebaths containing at least one dyestuff of the formula

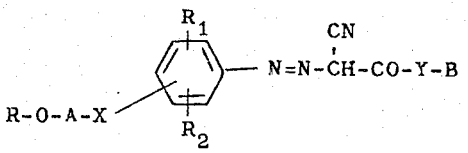

in which R is linear or branched alkylcarbonyl of 4 to 18 carbon atoms, X is oyxgen or sulfur, Y is a direct linkage or NH, A is linear or branched alkylene of 1 to 4 carbon atoms unsubstituted or substituted by methoxy, ethoxy, phenoxy or R as defined above, B is (1) phenyl unsubstituted or substituted by fluorine, chlorine, bromine, alkyl of 1 to 4 carbon atoms, alkoxy of 1 to 4 carbon atoms, trifluoromethyl, cyano, carboalkoxy, nitro, acetyl, benzoyl or phenyl, or (2) napthyl, $R_1$ is hydrogen or nitro, and $R_2$ is hydrogen, chlorine, bromine or methyl, and heating the impregnated fibrous materials to a temperature between 100°C and 240°C.

4 Claims, No Drawings

PROCESS FOR THE DYEING OF SYNTHETIC FIBROUS MATERIALS FROM ORGANIC SOLVENTS USING AZO DYES

It has been found that textile materials consisting of synthetic fibers or containing the same can be dyed in a continuous process from organic solvents by impregnating them with organic dyeing liquors containing dyestuffs of the formula (1)

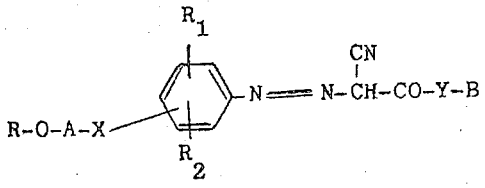

(1)

in which R is linear or branched alkylcarbonyl of 4 to 18 carbon atoms, X is oxygen or sulfur Y is a direct linkage or NH, A is linear or branched alkylene of 1 to 4 carbon atoms unsubstituted or substituted by methoxy, ethoxy or phenoxy or R as defined above, B is phenyl unsubstituted or substituted by fluorine, chlorine or bromine, by alkyl and/or alkoxy of 1 to about 4 carbon atoms, by trifluoromethyl, cyano, carbalkoxy, nitro, acetyl, benzoyl and/or phenyl or naphtyl, $R_1$ is hydrogen or nitro, $R_2$ is hydrogen, chlorine or bromine or methyl and subsequently fixing the dyestuffs on the fibrous material by a heat treatment.

It is preferred to use dyeing liquors containing dyestuffs of the formula (2)

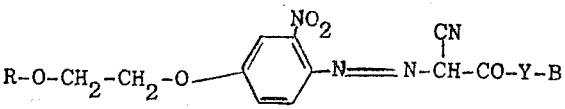

(2)

in which B, R and Y have the meaning given above.

The dyestuffs used in the process of this invention are prepared in known manner by acylating dyestuffs corresponding to the formulae (1) and (2) but with the proviso that R is a hydrogen atom, with the carboxylic acid of the formula (3)

$$R - OH \qquad (3)$$

in which R has the meaning given above or, preferably, with a functional derivative thereof, for example the acid anhydride or an acid halide, for example the acid bromide or, preferably the acid chloride, at temperatures of between about 20° and 100°C, suitably in an inert organic solvent or, optionally, in the presence of an acid-binding agent. Preferably used as acid-binding agents are pyridine, a mixture of pyridine bases, quinoline or a low-molecular trialkylamine, for example triethylamine. When using an acid halide of the formula (3), it is advantageous to add an acid-binding agent to the esterification mixture. Suitable as inert organic solvents are for example hydrocarbons such as benzene, toluene, xylene, halogenated hydrocarbons, such as chloroform, carbon tetrachloride, methylene chloride, trichloroethylene, chlorobenzene, bromobenzene; ketones, such as acetone, methyl-ethyl ketone, methylisobutyl ketone; and ethers, for example diethyl ether, diisopropyl ether, dioxane, 1,2-dimethoxyethane, methoxybenzene or ethoxybenzene as well as sulfolane (tetramethylene sulfolane).

It is possible by means of the dyestuffs used in the process of dyeing synthetic fiber material from organic solvents to obtain dyeings which are characterized by a high color yield, a very good build-up as well as outstanding fastness properties, in particular excellent fastness to sublimation (ironing), to washing, to rubbing and to light. Another advantage of the dyestuffs to be used in this process is their good solubility in organic solvents, as for example in alcohols and especially in halogenated hydrocarbons, whereby the dyeing process may be carried out, if necessary, also without solubilizers.

The preferably used dyebaths which contain the particularly valuable dyestuffs of formula (2) yield dyeings with a very good fastness to light and to sublimation (ironing).

Mixtures of the dyestuffs used according to the process of this invention sometimes give a better color yield than the individual dyestuffs and they also show sometimes a better solubility in the organic medium.

As synthetic fiber materials there may be used those consisting of high-molecular polyamides, polyolefins, polyacrilonitriles, and materials consisting of polyurethanes, polyvinyl chlorides, polyvinyl acetates as well as cellulose-2½-acetate and cellulose triacetate, in particular those from high-molecular polyesters such as polyethylene terephthalate. The said synthetic fibers may also be blended with one another or with natural fibers, such as cellulosic fibers or wool.

These fibrous materials may be dyed in any state of processing suitable for a continuous operation, for example as cables, combed material, filaments, yarns, knit or woven fabrics or non-woven articles.

As organic solvents to be used for the process of the invention, substances are suitable which boil at temperatures not exceeding 150°C under normal conditions, for example aliphatic hydrocarbons, such as the corresponding "Special boiling point benzines" (DIN 51 631/I. 59), aliphatic halogenated hydrocarbons, such as methylene chloride, dichloro-ethanes, trichloroethane, tetrachloroethane, dichloro-fluoromethane, dichloro-tetrafluoromethane and octafluoro-cyclobutane; aromatic hydrocarbons such as toluene and xylene; aromatic halogenated hydrocarbons, such as chlorobenzene and fluorobenzene. Especially suitable are trichlorofluoromethane, 1,2,2-trichloro-1,1,2-trifluoro-ethane, tetrachloro-ethylene, trichloro-ethylene and 1,1,1-trichloro-ethane.

Suitable solvents for this invention are also, for example, alcohols, preferably aliphatic alcohols having up to 4 carbon atoms. Mixtures of various solvents have proved to be suitable, especially, for example, mixtures of halogenated aliphatic hydrocarbons and/or aliphatic alcohols.

The padding liquors are prepared by dissolving the dyestuffs in the solvent or solvent mixture while stirring, and where required, while heating. For this purpose, the dyestuffs may be used in various forms, for example free from standardizing agents, as a concentrated solution in a solvent used according to the invention or in a mixture thereof or as a composition using auxiliaries soluble in solvents, for example oxalkylation products of fatty alcohols, alkyl-phenols, fatty acids and fatty acid amides.

The dyestuff solutions are applied onto the material most advantageously by padding, but also by other impregnation methods, such as spraying, slop-padding or immersing.

The impregnation operation is preferably carried out at room temperature but it may also be performed at higher or lower temperatures.

Prior to the dyestuff fixation, the textile material which has been treated with the dyeing liquor is then preferably dried, for example, by treating it with hot air, suctioning an inert gas (such as nitrogen) or air through it or applying superheated vapors, for example steam or solvent vapor, or by establishing a vacuum.

Subsequently, the dyestuffs are fixed by elevated temperatures, for example by means of hot air, dry heat, steam or solvent vapor.

The fixation temperatures to be observed depend on the melting point of the fiber type chosen and are generally between 100° and 240°C for the padding method. The heat treatment may be carried out in superheated steam or in vapors of organic solvents, moreover with the aid of molten metals, paraffins, waxes, oxalkylation products of alcohols or fatty acids or in eutectic mixtures of salts, preferably by means of dry heat, i.e., according to the so-called Thermosol process.

It is also possible to carry out the drying operation and the heat treatment in a single operation. The solvent vapors which escape during the drying or fixing operation are generally collected in suitable devices. The solvents thus recovered may then be used once more for the described dyeing process.

After the dyestuffs have been fixed, the unfixed dyestuff portion, if any, is removed by a suitable aftertreatment of the dyed material in order to improve the fastness properties of the goods. This aftertreatment is preferably performed in the same organic solvent as already used for the dyeing but it may also be carried out in different organic solvents or in aqueous liquors according to known methods.

The following Examples illustrate the invention. Parts and percentages are by weight unless stated otherwise.

EXAMPLE 1

6 Parts of the dyestuff of the formula

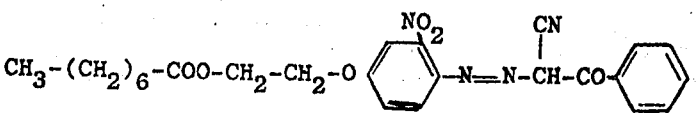

were dissolved in 1000 parts by volume of trichloroethylene at room temperature. This dyestuff solution was used for pad-dyeing a fabric made of polyester fibers on a padding machine with a squeezing effect of 80 % (weight of the padding liquor referred to the weight of the dry material). The fabric was then dried in a suitable apparatus and thermosoled for 1 minute at 210°C. A fast yellow dyeing was obtained.

Similar results were obtained when using instead of perchloroethylene the same amount of trichloroethylene.

The dyestuff was obtained by dissolving the dyestuff of the formula

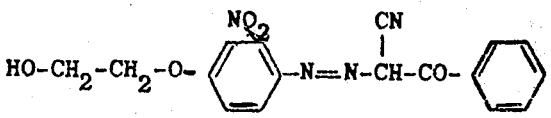

in chloroform and by acylating the product in known manner by heating with an acid chloride of the formula $CH_3-(CH_2)_6-CO-Cl$ in the presence of pyridine.

EXAMPLE 2

10 Parts each of the dyestuffs of the formulae

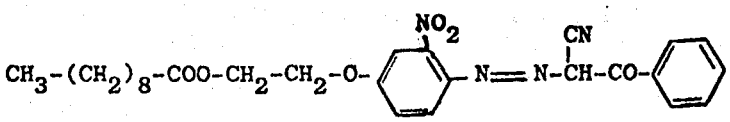

and

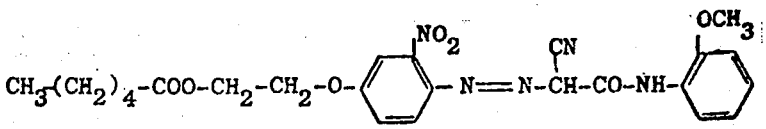

were dissolved in 1000 parts by volume of an azeotropic mixture consisting of 49,5 % of methylene chloride and 50,5 % of 1,2,2-trifluoro-trichloro-ethane at a temperature of 25°C. This dyebath was used for pad-dyeing a fabric made of polyester fibers on a foulard. The squeezing effect was about 90 %. The material was then dried and thermosoled for 1 minute at 210°C. A fast yellow dyeing was obtained.

The dyestuffs were obtained by dissolving the dyestuff of the formula

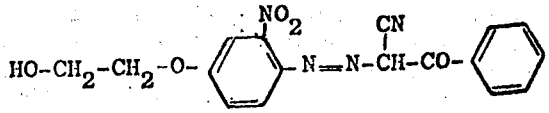

in toluene and by acylating in known manner by heating with the acid chloride of the formula $CH_3-(CH_2)_6-CO-Cl$ in the presence of quinoline and acylating the dyestuff of the formula

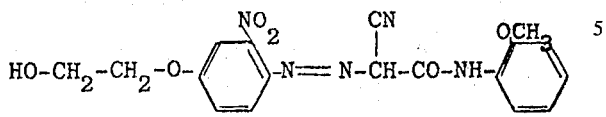

in corresponding manner with the acid chloride of the formula $CH_3-(CH_2)_4-CO-Cl$

EXAMPLE 3

6 Parts of the dyestuff of the formula

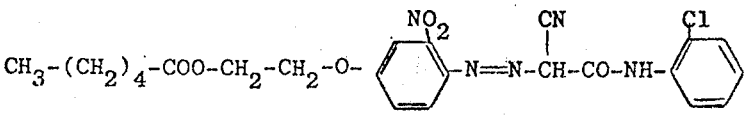

were dissolved in 1000 parts by volume of methylene chloride at room temperature. This dyebath was used to pad-dye a fabric made of polyester fibers on a foulard with a squeezing effect of 65 %. Then the material was dried, thermosoled for 1 minute at 210°C and after-washed for 5 minutes in cold state in the same solvent. A fast yellow dyeing was obtained.

The dyestuff was obtained by acylating the dyestuff of the formula

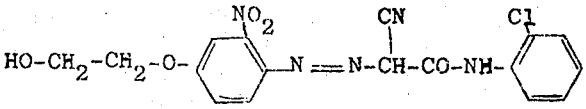

in known manner with the acid chloride of the formula $CH_3-(CH_2)_4-CO-Cl$

EXAMPLE 4

5 Parts of the dyestuff of the formula

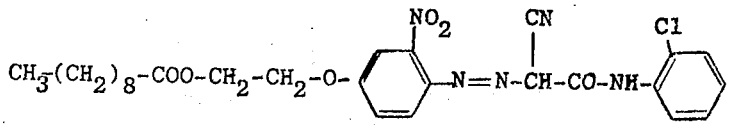

were dissolved in 1000 parts by volume of the solvent mixture defined in Example 2 at room temperature. This liquor was used to pad-dye a fabric made of polyester fibers on a foulard with a squeezing effect of 80 %. Then the material was dried and thermosoled for 1 minute at 210°C. A fast yellow dyeing was obtained.

The dyestuff was obtained, as described in Example 3, by acylation with an acid chloride of the formula $CH_3-(CH_2)_8-CO-Cl$

EXAMPLE 5

4 Parts of the dyestuff of the formula

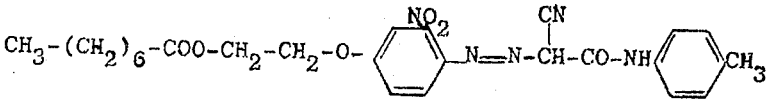

were dissolved in a mixture of 70 % by volume of perchloroethylene and 30 % by volume of methanol at room temperature. This liquor was used to pad-dye a fabric of polyester fibers on a foulard, the squeezing effect being about 70 %. Subsequently, the material was dried and thermosoled for 1 minute at 210°C. A fast yellow dyeing was obtained.

The dyestuff was prepared by acylating the dyestuff of the formula

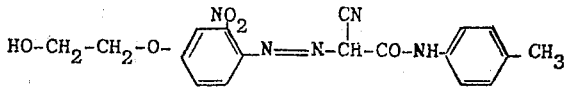

with the acid chloride of the formula $CH_3-(CH_2)_6-CO-Cl$ in a benzene solution by adding triethylamine as an acid-binding agent.

EXAMPLE 6

5 Parts of the dyestuff described in Example 5 and 10 parts of the dyestuff of the formula

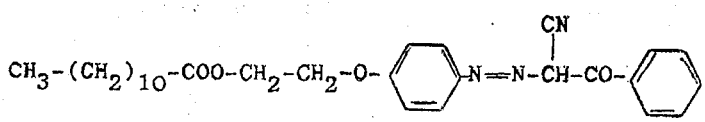

were dissolved in 1000 parts by volume of perchloroethylene at about 25°C. This dyeing liquor was used to pad-dye fabrics made of polyester, polyamide-6, polyamide-6,6 and cellulose triacetate fibers on a foulard. The squeezing effects varied between 65 % and 80 % according to the style of fabric. After padding, the fabrics were dried for 1 minute at 190°C (polyamide and cellulose triacetate) or 210°C (polyester), thermosoled and after-washed in cold state for 5 minutes in perchloroethylene. In all cases, fast yellow dyeings were obtained. The dyestuff mentioned above in the second place could be obtained, as described in Example 2, by acylation with an acid chloride of the formula $CH_3-(CH_2)_{10}-CO-Cl$

EXAMPLE 7

3 Parts of the dyestuff of the formula

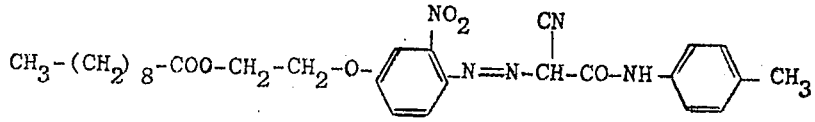

were dissolved in 1000 parts by volume of 1,1,1-trichloroethane at 30°C. This dyeing liquor was applied onto a fabric consisting of polyester fibers by dye-padding. The squeezing effect was about 65 %. After the padding, the material was dried and thermosoled for 1 minute at 210°C. A fast yellow dyeing was obtained.

The dyestuff was obtained, as described in Example 5, by acylation with the acid chloride of the formula $CH_3-(CH_2)_8-CO-Cl$

EXAMPLE 8

6 Parts of the dyestuff of the formula

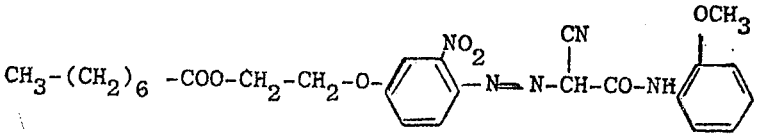

were dissolved in 1000 parts by volume of perchloroethylene at room temperature. This dyeing liquor was used to pad-dye a mixed fabric containing 67 % of polyester fibers and 33 % of cotton on a foulard with a squeezing effect of 85 %. After the padding, the fabric was dried and thermosoled for 1 minute at 210°C. Then the material was after-washed in cold state for 5 minutes in a solvent mixture containing 50 % by volume of methylene chloride and 50 % by volume of 1,2,2-trifluoro-trichloro-ethane. A fast yellow dyeing was obtained on the polyester portion of the mixed fabric.

The dyestuff was prepared by acylating the dyestuff of the formula

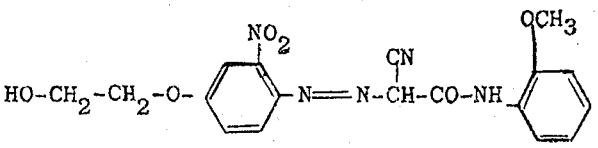

with the acid chloride of the formula $CH_3-(CH_2)_6-CO-Cl$ in toluene by adding pyridine.

EXAMPLE 9

8 Parts of the dyestuff of the formula

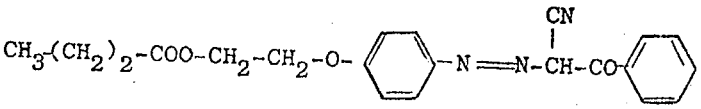

were dissolved in 1000 parts by volume of ethanol at 25°C. This dyeing liquor was used to pad-dye a fabric made of polyester fibers on a foulard with a squeezing effect of 40 %; then the material was dried and thermosoled for 1 minute at 210°C. A fast yellow dyeing was obtained.

The dyestuff could be prepared in known manner by acylation the dyestuff of the formula

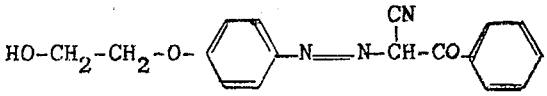

with the anhydride of the formula $CH_3-(CH_2)_2-COO-CO-(CH_2)_2-CH_3$

EXAMPLE 10

12 Parts of the dyestuff of the formula

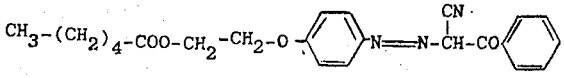

were dissolved in 1000 parts by volume of perchloroethylene at room temperature. This dyeing liquor was used to pad-dye fabrics made of polyester fibers, polaymide-6 and polyamide-6,6 fibers, cellulose-2½ and cellulose triacetate fibers, yarn consisting of polyvinyl chloride fibers and combed material made of polypropylene fibers on a foulard. The squeezing effects varied, according to the kind of material used, between 65 and 90 %. After the padding operation, the material was dried and steamed for 30 minutes at 102° to 103°C. Then, the dyed material was after-washed in cold perchloroethylene. Fast yellow dyeings were obtained in all cases.

The dyestuff was prepared as described in Example 9, by using the acid chloride of the formula $CH_3(CH_2)_4-CO-Cl$ as the acylating agent.

EXAMPLE 11

7 Parts of the dyestuff of the formula

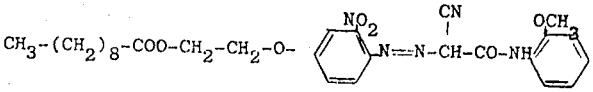

were dissolved in 1000 parts by volume of perchloroethylene at room temperature and applied onto a fabric made of polyester by padding. The squeezing effect was 80 %. After the padding operation, the material was dried and thermosoled for 1 minute at 210°C.

A fast yellow dyeing was obtained.

The dyestuff was prepared, as described in Example 9, by using the acid chloride of the formula $CH_3-(CH_2)_8-CO-Cl$

EXAMPLE 12

5 Parts of the dyestuff of the formula

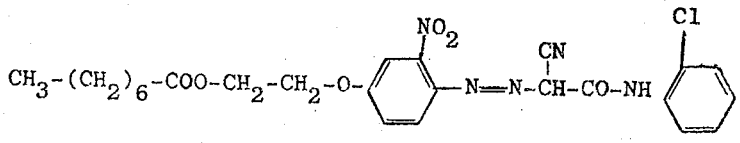

were dissolved in 1000 parts by volume of perchloroethylene at 25°C. This dyeing liquor was used to pad-dye a fabric made of polyester fibers on a foulard with a squeezing effect of 80 %. Then the material was dried, thermosoled for 1 minute at 210°C and after-washed for 5 minutes in cold perchloroethylene. A fast yellow dyeing was obtained.

Similar results could be obtained when the dyestuff was fixed not by hot air but by a steaming process (30 minutes at 102° to 103°C in water steam or 10 minutes at 150°C in overheated perchloroethylene vapor).

The dyestuff was prepared as described in Example 3, yet by using the acid chloride of the formula $CH_3-(CH_2)_6-CO-Cl$

EXAMPLE 13

7 Parts of the dyestuff of the formula

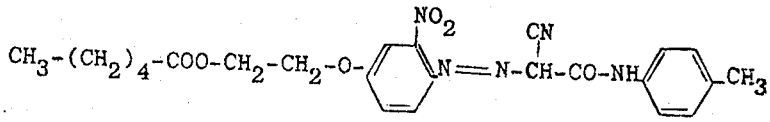

were dissolved in 1000 parts by volume of perchloroethylene at 25°C. This dyeing liquor was used to pad-dye a fabric of polyester fibers on a foulard with a squeezing effect of 80 %. Then, the material was dried and thermosoled for 1 minute at 210°C. A fast yellow dyeing was obtained.

The dyestuff was prepared as described in Example 5, by using the acid chloride of the formula $CH_3-(CH_2)_4-CO-Cl$

EXAMPLE 14

7 Parts of the dyestuff of the formula

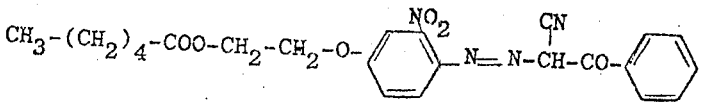

were dissolved in 1000 parts by volume of perchloroethylene at 25°C. This dyeing liquor was used to pad-dye a fabric of polyester fibers, the squeezing effect being 80 %. Then, the fabric was dried and thermosoled for 1 minute at 210°C. A fast yellow dyeing was obtained.

A similar result was obtained by replacing the perchloroethylene by the same amount by volume of methanol. The squeezing effect was 40 %.

The dyestuff was prepared as described in Example 1, using the acid chloride of the formula $CH_3-(CH_2)_4-CO-Cl$ The following Table lists further dyestuffs of the formula (1)

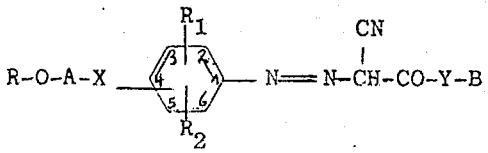

which may be used in the process of the invention and which yield, when applied according to the above dyeing prescriptions, yellow to orange dyeings on polyester fibers.

| Ex. No. | X | Y | A | B | $R_1$ | $R_2$ | R |
|---|---|---|---|---|---|---|---|
| 15 | 4-O | NH | $-C_2H_4-$ | 2-methyl-phenyl | 2-$NO_2$ | H | $(CH_3)_3CCO-$ |
| 16 | " | " | " | 4-t-butyl-phenyl | " | " | $CH_3(CH_2)_3CO-$ |
| 17 | " | " | " | 4-i-propyl-phenyl | " | " | $CH_3(CH_2)_{16}CO-$ |
| 18 | " | " | " | 4-ethyl-phenyl | " | " | $(CH_3)_2CHCH_2CO-$ |
| 19 | " | " | " | 2-bromo-phenyl | " | " | $(CH_3)_2CH(CH_2)_4CO-$ |
| 20 | " | " | " | 2-methyl-5-chloro-phenyl | " | " | $CH_3(CH_2)_6CO-$ |
| 21 | " | " | " | 3-trifluoromethyl-phenyl | " | " | $CH_3(CH_2)_6CO-$ |
| 22 | " | " | " | 2-nitro-phenyl | " | " | $CH_3(CH_2)_6CO-$ |
| 23 | " | " | " | -naphthyl | " | " | $CH_3(CH_2)_6CO-$ |
| 24 | " | " | " | 4-fluoro-phenyl | " | " | $CH_3(CH_2)_6Co-$ |
| 25 | " | " | " | 3-cyano-phenyl | " | " | $CH_3(CH_2)_6CO-$ |

-continued

| Ex. No. | X | Y | A | B | $R_1$ | $R_2$ | R |
|---|---|---|---|---|---|---|---|
| 26 | " | " | " | 4-carbethoxy-phenyl | " | " | $CH_3(CH_2)_6CO$— |
| 27 | " | " | " | 4-n-butoxy-phenyl | " | " | $CH_3(CH_2)_4CO$— |
| 28 | " | " | " | 2-ethoxy-phenyl | " | " | $CH_3(CH_2)_4CO$— |
| 29 | " | " | " | 4-nitro-2-methoxy-phenyl | " | " | $CH_3(CH_2)_4CO$— |
| 30 | " | " | " | 4-trifluoromethyl-2nitro-phenyl | " | " | $CH_3(CH_2)_4CO$— |
| 31 | " | " | " | 3-acetyl-phenyl | " | " | $CH_3(CH_2)_4CO$— |
| 32 | " | " | " | 3-benzoyl-phenyl | " | " | $CH_3(CH_2)_4CO$— |
| 33 | " | " | " | 4-biphenyl | " | " | $CH_3(CH_2)_4CO$— |
| 34 | " | " | —$CH_2$— | phenyl | " | " | $CH_3(CH_2)_4CO$— |
| 35 | " | " | —$CH(CH_3)CH_2$— | 3-methoxy-phenyl | " | " | $CH_3(CH_2)_4CO$— |
| 36 | " | " | —$CH_2CH(O—CO(CH_2)_2CH_3)CH_2$— | 4-ethyl-phenyl | " | " | $CH_3(CH_2)_2CO$ |
| 37 | " | — | —$CH(CH_2—O—C_6H_5)CH_2$— | phenyl | 2-$NO_2$ | H | $CH_3(CH_2)_2CO$— |
| 38 | " | — | —$CH(CH_2—OCH_3)CH_2$— | phenyl | " | " | $CH_3(CH_2)_2CO$— |
| 39 | " | — | —$(CH_2)_3$— | phenyl | " | " | $CH_3(CH_2)_2CO$ |
| 40 | " | — | —$C_2H_4$— | phenyl | " | 5-Cl | $CH_3(CH_2)_{10}CO$— |
| 41 | " | — | —$C_2H_4$— | phenyl | " | 6-Br | $CH_3(CH_2)_{10}CO$— |
| 42 | " | — | —$C_2H_4$— | phenyl | H | 3-$CH_3$ | $CH_3(CH_2)_{10}CO$— |
| 43 | " | — | —$C_2H_4$— | phenyl | H | 3-Cl | $CH_3(CH_2)_8CO$— |
| 44 | 4-S | — | —$C_2H_4$— | phenyl | 3-$NO_2$ | H | $CH_3(CH_2)_8CO$— |
| 45 | " | NH | —$C_2H_4$— | phenyl | 2-$NO_2$ | H | $CH_3(CH_2)_8CO$— |
| 46 | " | NH | —$C_2H_4$— | 3-chloro-phenyl | H | H | $CH_3(CH_2)_3CO$— |
| 47 | " | " | —$C_2H_4$— | 2,4-dimethyl-phenyl | H | H | $(CH_3)_3CCO$— |
| 48 | 2-S | " | —$C_2H_4$— | 2,4-dimethyl-phenyl | H | H | $CH_3(CH_2)_4CO$— |
| 49 | 2-O | " | —$C_2H_4$— | 2,4-dimethyl-phenyl | 5-$NO_2$ | H | $CH_3(CH_2)_4CO$— |
| 50 | " | — | —$C_2H_4$— | phenyl | " | H | $CH_3(CH_2)_6CO$— |
| 51 | 3-O | — | —$C_2H_4$— | phenyl | 4-$NO_2$ | H | $CH_3(CH_2)_6CO$— |
| 52 | " | NH | —$C_2H_4$— | 2-ethoxy-phenyl | " | H | $CH_3(CH_2)_6CO$— |
| 53 | 4-O | " | —$CH(CH_2—OCH_3)CH_2$— | 4-methoxy-phenyl | H | H | $CH_3(CH_2)_6CO$— |
| 54 | 4-S | " | —$C_2H_4$— | α-naphthyl | H | H | $CH_3(CH_2)_6CO$— |
| 55 | " | " | —$C_2H_4$— | α-naphthyl | 2-$NO_2$ | H | $CH_3(CH_2)_6CO$— |

We claim:

1. A process for the continuous dyeing of textile materials consisting of or containing synthetic fibrous materials of the group consisting of high molecular polyamides, polyolifines, polyacrylonitriles, polyurethanes, polyvinylchlorides, polyvinylacetates, cellulose-2½-acetate, cellulose-triacetate and high molecular polyesters, from organic solvents, which comprises impregnating the said fibrous materials with organic dyebaths containing at least one dyestuff of the formula

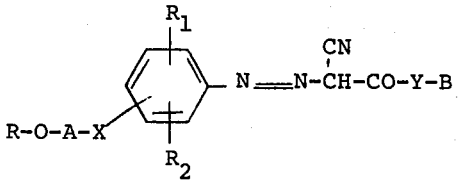

in which R is linear or branched alkylcarbonyl of 4 to 18 carbon atoms, X is oxygen or sulfur, Y is a direct linkage or NH, A is linear or branched alkylene of 1 to 4 carbon atoms unsubstituted or substituted by methoxy, ethoxy, phenoxy or R as defined above, B is (1) phenyl unsubstituted or substituted by fluorine, chlorine, bromine, alkyl of 1 to 4 carbon atoms, alkoxy of 1 to 4 carbon atoms, trifluoromethyl, cyano, carboalkoxy, nitro, acetyl, benzoyl or phenyl, or (2) naphthyl, $R_1$ is hydrogen or nitro, and $R_2$ is hydrogen, chlorine, bromine or methyl, and heating the impregnated fibrous materials to a temperature between 100°C and 240°C.

2. The process as claimed in claim 1, wherein the organic solvent in the dyebath is an organic solvent having a boiling point of at most 150°C under standard conditions.

3. The process as claimed in claim 1, wherein the organic solvent in the dyebath is an aliphatic hydrocarbon, aliphatic chlorinated hydrocarbon, aromatic hydrocarbon, chlorinated aromatic hydrocarbon, aliphatic alcohol having from 1 to 4 carbon atoms, or mixture thereof, the boiling point of which does not exceed 150°C under standard conditions.

4. The process as claimed in claim 1, wherein the organic solvent in the dyebath is a special boiling point spirits, methylenechloride, dichloroethane, trichloroethane, trichloro-fluoro-methane, trichloroethylene, tetrachloroethane, tetrachloroethylene, dichlorofluoromethane, trichloro-trifluoro-ethane, dichloro-tetrafluoro-ethane, octafluorocyclobutane, toluene, xylene, chlorobenzene or fluorobenzene, or mixture thereof.

* * * * *